United States Patent [19]

Poulsen

[11] Patent Number: 4,923,260

[45] Date of Patent: May 8, 1990

[54] REFRIGERATOR SHELF CONSTRUCTION

[75] Inventor: Douglas Poulsen, Lakeview, Mich.

[73] Assignee: White Consolidated Industries, Inc., Cleveland, Ohio

[21] Appl. No.: 400,280

[22] Filed: Aug. 29, 1989

[51] Int. Cl.[5] ..... A47B 81/00

[52] U.S. Cl. ..... 312/214; 108/155; 211/153; 211/186; 24/545

[58] Field of Search ..... 312/214, 306, 293; 24/545, 546, 563; 108/155, 157; 211/153, 186

[56] References Cited

U.S. PATENT DOCUMENTS

| | | | |
|---|---|---|---|
| 2,857,227 | 10/1958 | Jacques | 108/157 X |
| 3,912,085 | 10/1985 | Cooke et al. | 211/153 |
| 4,462,646 | 7/1984 | Fleck | 312/214 |
| 4,735,470 | 4/1988 | Falk | 312/214 X |
| 4,736,997 | 4/1988 | Besore et al. | 312/214 X |
| 4,760,930 | 8/1988 | Fox | 211/153 |
| 4,779,939 | 10/1988 | Stich | 312/214 |

*Primary Examiner*—Joseph Falk

*Attorney, Agent, or Firm*—Pearne, Gordon, McCoy & Granger

[57] ABSTRACT

A household refrigerator cabinet housing therein a plurality of vertically adjustable shelf assemblies each supporting a shelf for placing refrigerable items thereon. Each shelf assembly has a pair of cantilever arms with transverse clips on the front end for holding the front edge of a shelf, and hooks on the rear end for mounting the shelf assembly on a pair of ladder tracks attached to the rear wall of a refrigerator. A rigid wire spans the distance between the cantilever arms near their rear end and is rigidly connected thereto. A unitary shelf retainer having two perpendicularly disposed slots is press fit on the support wire. The first slot is defined by two walls extending in a converging manner from a third wall so as to firmly grasp the shelf when placed therein. The second slot is defined by two walls extending perpendicularly downwardly in a converging manner from the first slot and having spherical protrusions on their ends to firmly grasp the support wire when press fit thereon. A transitional flange runs the length of the shelf retainer extending away from it in a curving manner.

4 Claims, 4 Drawing Sheets

REFRIGERATOR SHELF CONSTRUCTION

BACKGROUND OF THE INVENTION

The present invention relates to compartments which house vertically moveable shelf assemblies and particularly to household frost-free refrigerators having a plurality of vertically adjustable shelf assemblies.

Household refrigerators commonly contain food storage bins and a plurality of shelf assemblies used to hold refrigerable products. Traditionally, these shelf assemblies are made of spaced apart horizontally disposed rigid wires attached to a perimetric wire and were positioned at various heights within the refrigerator compartment. The shelf assembly is held in place with brackets or similar means mounted on the interior walls of the refrigerator compartment. This configuration for a shelf tends to lack aesthetic appeal and the structure allows liquids and food stuffs to fall through the spaced apart wires. Thus, manufacturers have introduced solid translucent or transparent glass shelves to enhance the interior aesthetics of the refrigerator and to be more pleasing to the consumer. Solid glass shelves also prevent food stuffs or liquids from passing through the shelves onto food stuffs below.

For a frost-free refrigerator to function properly refrigerated air must circulate throughout the refrigerator compartment. Conventional wire shelves allow refrigerated air to pass between the wires and circulate adequately. Solid glass shelves must be positioned a distance away from the rear and side walls of the refrigerator compartment to allow the refrigerated air to circulate efficiently. Present frameworks to hold glass shelves in such a position are somewhat complex and, due to their inability to hold close tolerances, allow the glass shelves to move and impact on the metal components of the framework causing an excessive rattling. To alleviate these problems a rigid unitary rectangular framework is necessary to hold glass shelves firmly in place away from the rear and side walls of the refrigerator. Such a framework may be adjustably mounted on a set of two ladder tracks attached to the rear of the refrigerator compartment.

SUMMARY OF THE INVENTION

To overcome the foregoing concerns it is necessary to provide a rigid unitary framework which will firmly grasp a glass shelf at each of its four corners or along an entire edge if feasible. Such a framework has two cantilevered shelf supports designed to interact with the ladder tracks thereby supporting the entire assembled framework in position. Each centilevered shelf support has near its forward end a transverse "U" shaped supporting bracket into which the front edge of a glass shelf is placed. Toward the rear of the cantilevered arms is a horizontal wire spanning the entire distance between them which acts as a support for the rear portion of a glass shelf. A retaining device is used in conjunction with the support wire to rigidly hold a glass shelf in place the requisite distance from the rear and side walls of the refrigerator compartment. Such a retaining device spans the entire rear edge of a glass shelf and has a flange to prevent food stuffs from being pushed off the rear end of the glass shelf due to the gap between the glass shelf and the rear wall of the refrigerator compartment. When the framework is assembled it is adjustably mounted on the ladder tracks in the refrigerator compartment and can be easily removed for cleaning or replacement.

One feature of the preferred embodiment of the glass shelf retainer is to provide a means within a rigid unitary framework for grasping a glass shelf and holding it firmly in place. Because the glass shelf is held rigidly in position it does not come in contact with the metal elements of the framework thereby preventing any excessive rattling. Furthermore, the framework stabilizes the glass shelf far enough away from the rear and side walls of the refrigerator so the circulation of air is not impeded. Another feature is to prevent food stuffs from being pushed so far back on the glass shelf that they fall off the rear of the shelf or hang over the end of the shelf thereby restricting the circulation of refrigerated air; this is accomplished with a transitional flange spanning the length of the retaining device.

The glass shelf retainer comprises an elongated extrusion having a pair of perpendicularly disposed slots. One slot is adapted to grasp a glass shelf thereby holding it firmly in place, and the second slot is adapted to press fit on a support wire which horizontally spans the distance between two cantilevered shelf supports. The shelf retainer is press fit over the support wire so the slot adapted to grasp the shelf is substantially horizontal. As such, the rear edge of the shelf can be inserted in the shelf retainer. The front corners of the shelf are inserted in support clips mounted on the forward end of the cantilever arm shelf supports. Thus situated, decorative trim is secured over the front edge of the shelf and the shelf assembly is ready for mounting in the refrigerator compartment.

Each perpendicularly disposed slot is defined by a set of three walls; two of the walls extending from the third wall in a converging manner thereby creating a compressive force. One slot is designed to be press fit on a support wire and the other slot is designed to firmly grasp a glass shelf. Thus, when the framework is assembled the glass shelf is held stationary and does not come into contact with any metal components of the framework.

When an assembled framework is mounted inside the refrigerator compartment there is an area where the glass shelf encroaches the rear wall of the compartment. The glass shelf retainer provides a transitional flange which creates a radius of curvature from the shelf toward the rear vertical wall of the refrigerator compartment. The transitional flange prevents food stuffs from wedging between the glass shelf and the rear wall or falling off the rear edge of the shelf.

DESCRIPTION OF THE PREFERRED EMBODIMENT

Figure 1:
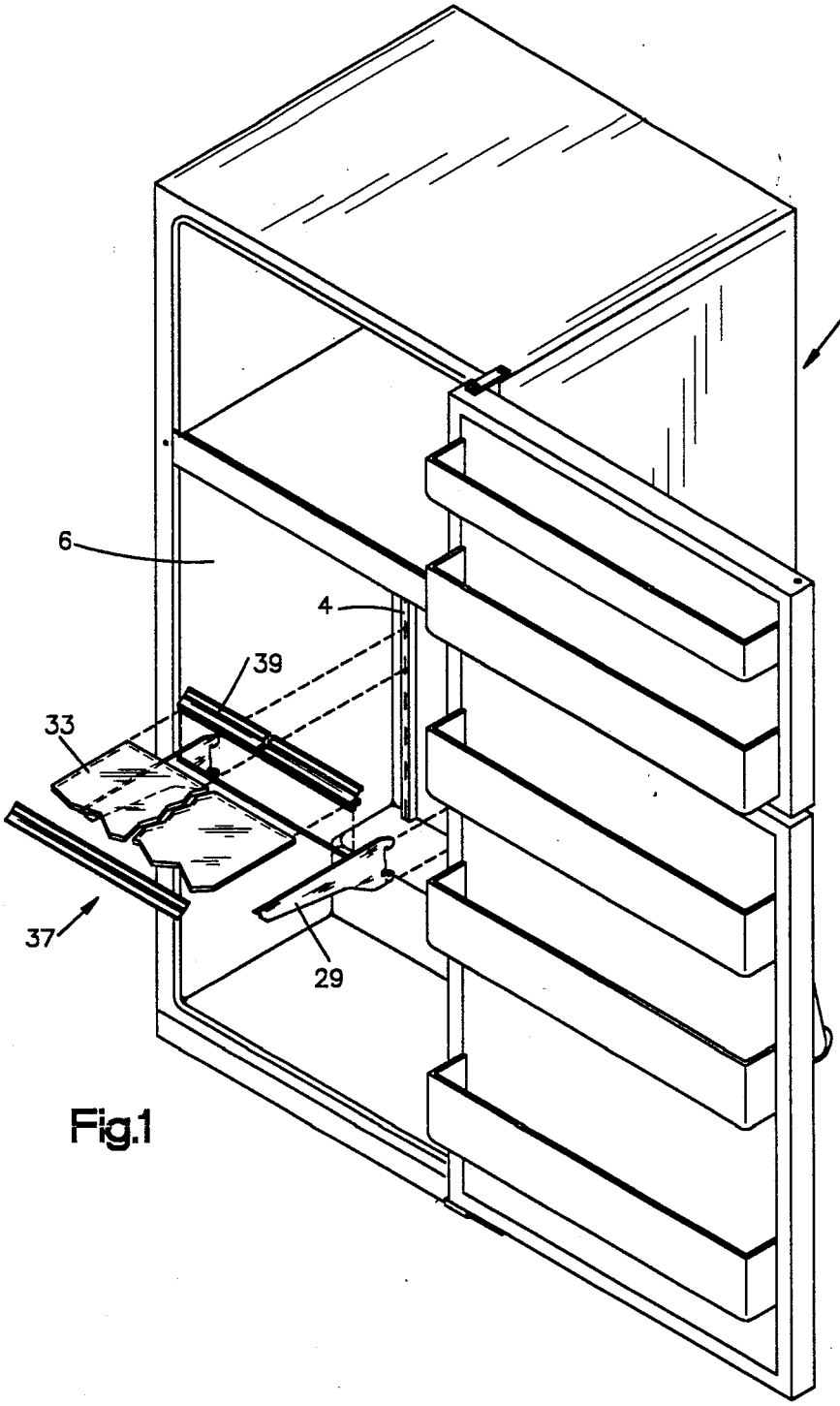
FIG. 1 is a perspective view of the front of a household refrigerator with an exploded view of the shelf assembly according to the preferred embodiment of the invention.
Figure 2:
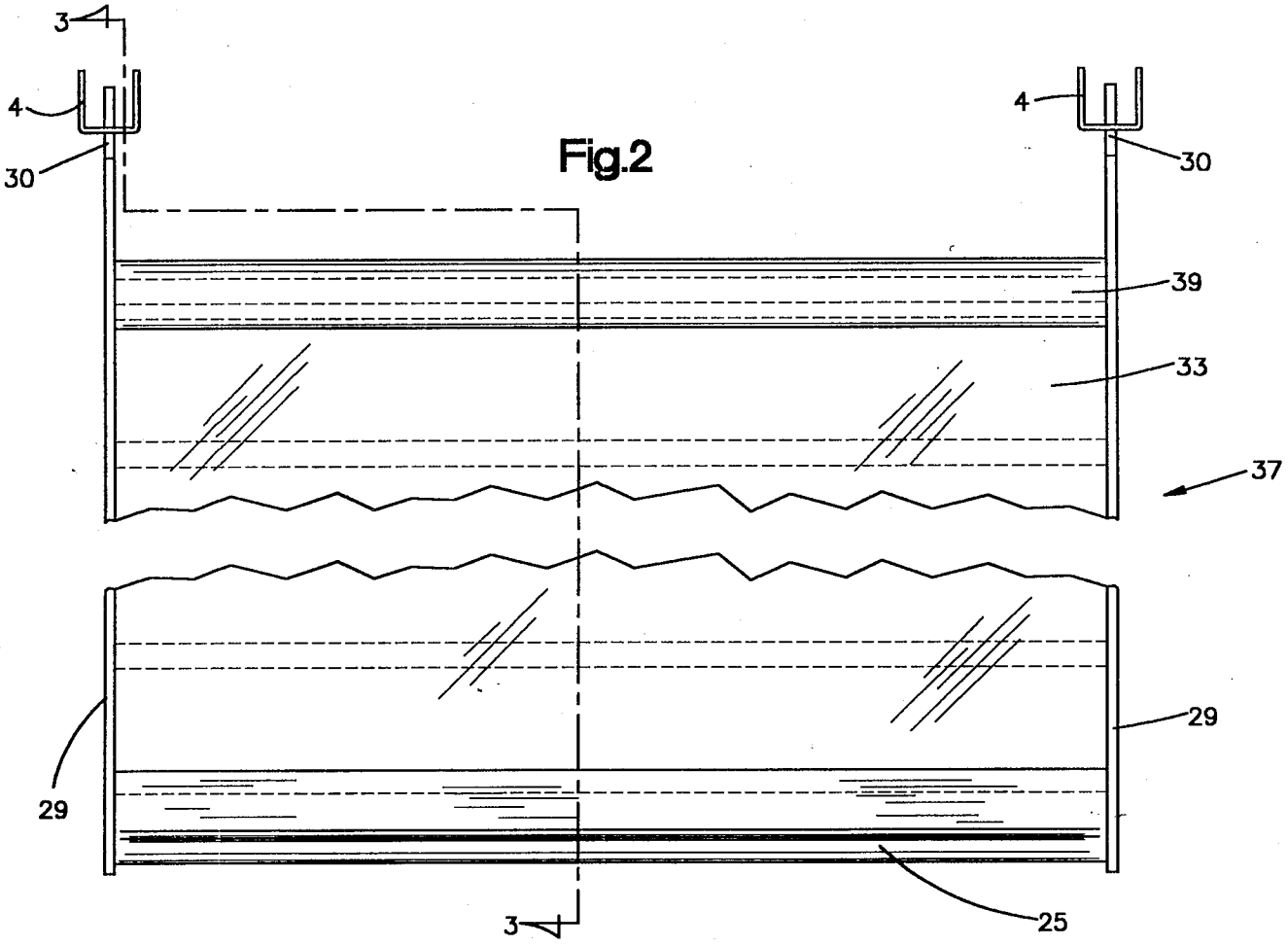
FIG. 2 is a top plan view of the shelf assembly of FIG. 1.

With particular reference to FIG. 1 of the drawings, there is shown a conventional household refrigerator cabinet 2 including a food storage compartment 6. The refrigerator is of the frost-free type and refrigerates food by circulating refrigerated air throughout the compartment 6. Compartment 6 has mounted on its rear vertical wall two vertically disposed ladder tracks 4 used to adjustably mount a plurality of shelf assemblies such as shelf assembly 37. The vertically disposed ladder tracks 4 are spaced apart a distance equivalent to the width of shelf assembly 37. It is desirable that each shelf assembly 37 be vertically adjustable in order to provide spacing between the shelf assemblies as required by the user. The ladder tracks are a convenient way for moving the shelf assemblies to whatever height the user wants them.

Figure 3:
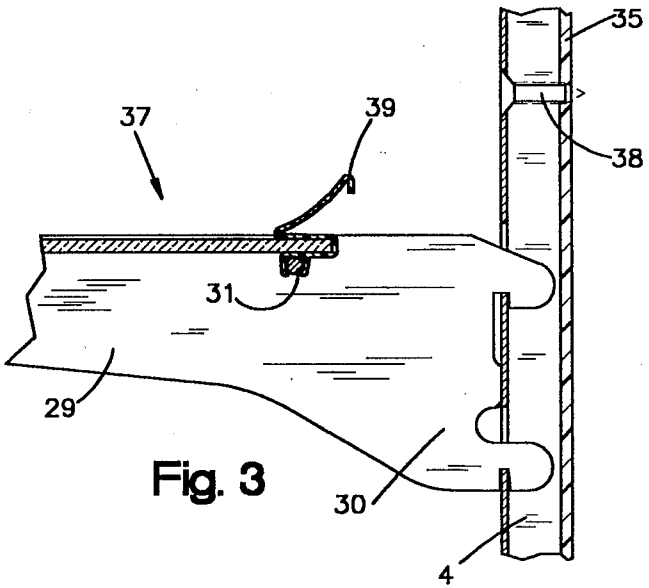
FIG. 3 is a cross-sectional elevational view, with parts broken away, of the shelf assembly.

Referring to FIG. 3 each shelf assembly 37 has two cantilevered shelf supports 29 each having a base secured to the adjacent ladder tracks and having rigidly secured therebetween at the front or free ends a transverse "U" shaped front cross member 23 with an indentation 24 thereon. The shelf 33 has a protective rubber clip 27 on the perimeter of its front edge which is inserted into the front cross member 23 and tightly held in place with indentation 24 acting as a stop. A section of front decorative trim 25 is then secured over the front of the shelf assembly 37.

The shelf retainer 39 is a unitary member disposed between the two cantilevered shelf supports 29 and rests upon rear support wire 31 which is rigidly secured at each end to one of the cantilevered shelf supports 29. When each shelf assembly 37 is assembled, the shelf 33 is inserted into the shelf retainer 39 and there held in place as shown in FIG. 3. The shelf assembly 37 is then adjustably mounted within compartment 6 via the cantilevered shelf supports 29 which engage the vertically disposed ladder tracks 4 and rigidly maintain each shelf assembly 37 in place. The vertically disposed ladder tracks 4 are connected to the rear vertical wall 35 by means of a sheet metal screw 38 as shown in FIG. 3. When in position, the shelf retainer 39 situates the shelf 33 so as to not restrict the circulation of refrigerated air between the shelf 33 and the rear or side walls of the refrigerator compartment 6.

Figure 4:
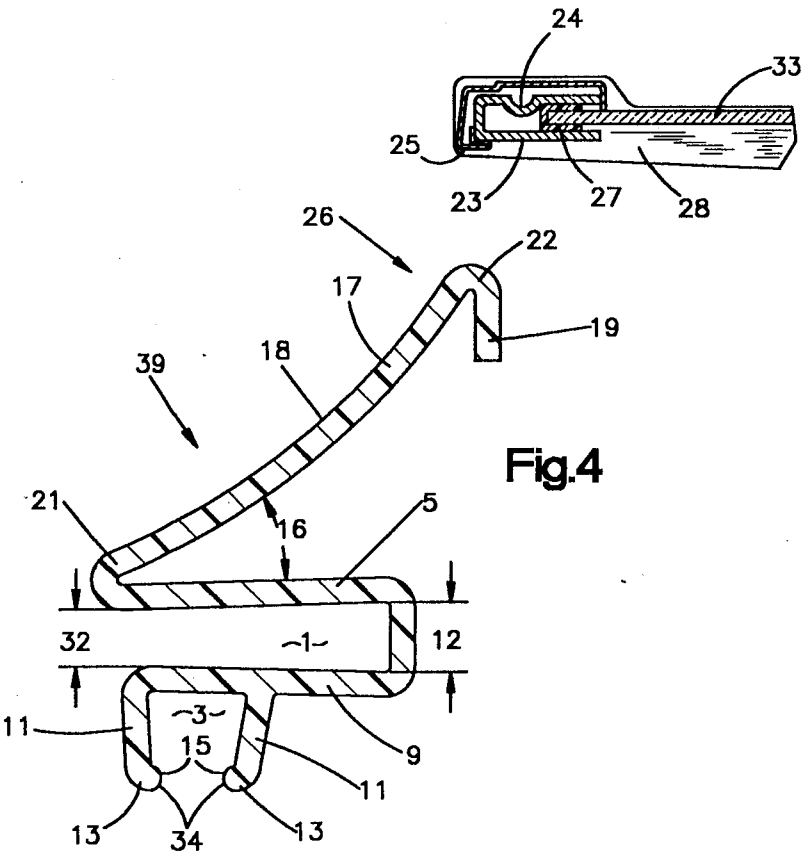
FIG. 4 is an elevational end view of the shelf retainer of the preferred embodiment of the invention.

With reference to FIG. 4 there is shown an end view of the self retainer 39. The preferred embodiment of the shelf retainer 39 is a one piece extrusion of suitable plastic material. The shelf retainer has substantially perpendicularly or angularly disposed slots 1 and 3. The slot 1 is substantially rectangular and defined by end wall 7, upper wall 5 and lower wall 9. Upper wall 5 and lower wall 9 are rigidly affixed to end wall 7 and disposed a distance apart defined by the height 12 of end wall 7. Upper wall 5 and lower wall 9 extend away from end wall 7 in a converging manner to form opening 32 of the slot 1 and provide a frictional grip on the glass shelf 33. The slot 3 is substantially square and defined by two vertical walls 11 rigidly affixed to and extending downwardly from the outer end of lower wall 9. Vertical walls 11 extend downwardly in a converging manner to form opening 34 of the slot 3. The lower end 13 of each vertical wall 11 has a spherical protrusion 15 attached thereto. The spherical protrusion 15 is adapted to grasp support wire 31 when the shelf retainer 39 is press fit over support wire 31.

Rigidly affixed to the top of upper wall 5 is a transitional flange 17 having a radius of curvature 18, a bend 22, a lower terminal end 21, and an upper terminal end 19. The transitional flange 17 extends rearwardly and upwardly in relation to opening 32 of the slot 1. The relationship between the transitional flange 17 and the upper wall 5 is such that an acute angle 16 is formed therebetween. The upper portion 26 of terminal flange 17 has a bend 22 causing upper terminal end 19 to face downwardly in a substantially perpendicular manner relative to upper wall 5. Transitional flange 17 is used to prevent food items from blocking air flow between the shelf 33 and the rear vertical wall of the refrigerator compartment 6; it also prevents food items from falling off the rear part of the shelf 33.

Figure 5:
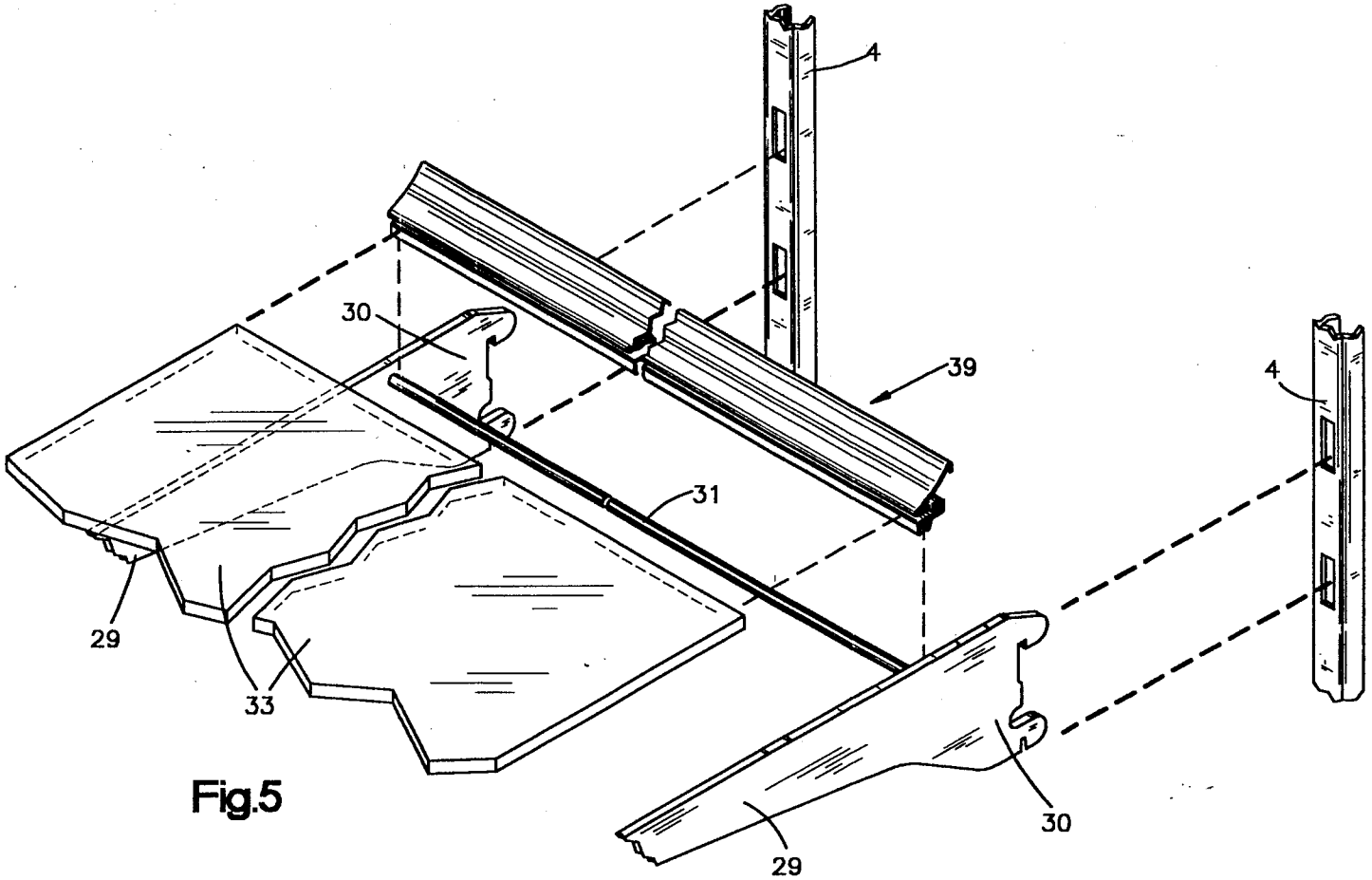
FIG. 5 is an exploded perspective partial view of the shelf assembly.

Referring to FIG. 5, there is shown a partial perspective exploded view of shelf assembly 37. Fig. 5 depicts the relationship between the shelf retainer 39, the cantilevered shelf supports 29, the vertically disposed ladder tracks 4, the support wire 31, and the glass shelf 33. These components are easily assembled and the shelf assembly is ready for use in the refrigerator.

Although the preferred embodiment of this invention has been shown and described, it should be understood that various modifications and rearrangements of the parts may be resorted to without departing from the scope of the invention as disclosed and claimed herein.

What is claimed is:

1. In a refrigerator having a food compartment, a rear wall, ladder tracks secured to said rear wall, and a shelf assembly mounted on said ladder tracks, said shelf assembly comprising a pair of cantilever shelf supports each having a base secured to said ladder tracks and a front end, a transverse cross member secured at the ends to said cantilever shelf support front ends and having a glass shelf receiving slot, a glass shelf having front and rear edges, said front edge received in said shelf receiving slot, and a rear support wire secured at the ends to said cantilever shelf support bases, a unitary shelf retainer extending between said cantilever shelf supports adjacent said support wire, said retainer having, a pair of longitudinally extending angularly disposed slots, the first of said slots opening forwardly and adapted to receive the rear edge of said glass shelf, and the second of said slots opening downwardly and adapted to receive said support wire.

2. A unitary shelf retainer as recited in claim 1, and further comprising:

a transitional flange extending the length of said unitary shelf retainer and having a radius of curvature defining an upper terminal end and a lower terminal end, said transitional flange rigidly secured to said unitary shelf retainer.

3. A unitary shelf retainer as recited in claim 2, wherein:

said first slot being substantially rectangular and defined by an upper wall, an end wall and a lower wall, said upper wall and said lower wall extending substantially perpendicularly away from said end wall; and said second slot being substantially square and defined by a first wall and a second wall, said first wall and said second wall extending substantially perpendicularly downwardly from said lower wall.

4. A unitary shelf retainer as recited in claim 3, wherein:

said upper wall and said lower wall extend perpendicularly away from said end wall in a converging manner;

said first wall and said second wall extend perpendicularly away from said lower wall in a converging manner, said first wall and said second wall having on their lower end a spherical protrusion adapted to firmly grasp the support wire when said second slot is press fit onto the support wire;

said upper terminal end of said transitional flange is adapted to rest a distance away from the rear wall of the food compartment;

said lower terminal end of said transitional flange is rigidly secured to the upper surface of said lower wall.

* * * * *